US009003317B2

(12) United States Patent
Beaudet et al.

(10) Patent No.: US 9,003,317 B2
(45) Date of Patent: Apr. 7, 2015

(54) METHOD OF SORTING ARTICLES FOR TREATMENT ACCORDING TO A CYCLE OF OPERATION IMPLEMENTED BY AN APPLIANCE

(75) Inventors: Douglas B. Beaudet, Mattawan, MI (US); Nima Motamedi, Astoria, NY (US)

(73) Assignee: Whirlpool Corporation, Benton Harbor, MI (US)

( * ) Notice: Subject to any disclaimer, the term of this patent is extended or adjusted under 35 U.S.C. 154(b) by 486 days.

(21) Appl. No.: 13/251,349

(22) Filed: Oct. 3, 2011

(65) Prior Publication Data

US 2013/0086520 A1 Apr. 4, 2013

(51) Int. Cl.

| | |
|---|---|
| ***G06F 3/048*** | (2013.01) |
| ***D06F 93/00*** | (2006.01) |
| *D06F 39/00* | (2006.01) |
| *D06F 33/02* | (2006.01) |

(52) U.S. Cl.

CPC ..... *D06F 93/00* (2013.01); *D06F 39/005* (2013.01); *D06F 33/02* (2013.01); *D06F 2210/00* (2013.01)

(58) Field of Classification Search

CPC ..... D06F 2210/00; D06F 2216/00; D06F 39/005; A47L 15/0063; A47L 15/0097

USPC ..... 715/751

See application file for complete search history.

(56) References Cited

U.S. PATENT DOCUMENTS

| | | | | |
|---|---|---|---|---|
| 5,553,123 | A | 9/1996 | Chan et al. | |
| 6,256,378 | B1 | 7/2001 | Iggulden et al. | |
| 6,415,023 | B2 | 7/2002 | Iggulden | |
| 6,483,906 | B1 | 11/2002 | Iggulden et al. | |
| 6,882,712 | B1 | 4/2005 | Iggulden et al. | |
| 6,949,729 | B1 | 9/2005 | Ishikawa et al. | |
| 7,069,091 | B2 | 6/2006 | Williamson | |
| 7,181,291 | B2 | 2/2007 | Boldt et al. | |
| 7,215,746 | B2 | 5/2007 | Iggulden et al. | |
| 7,289,611 | B2 | 10/2007 | Iggulden et al. | |
| 7,379,541 | B2 | 5/2008 | Iggulden et al. | |
| 7,415,102 | B2 | 8/2008 | Iggulden et al. | |
| 7,503,088 | B2 * | 3/2009 | Jo et al. | 8/158 |
| 7,514,658 | B2 | 4/2009 | Kim | |
| 7,516,629 | B2 * | 4/2009 | Behrens et al. | 68/12.12 |
| 2002/0095483 | A1 | 7/2002 | Lee et al. | |
| 2004/0134237 | A1 * | 7/2004 | Sunshine et al. | 68/3 R |
| 2004/0134238 | A1 * | 7/2004 | Buckroyd et al. | 68/12.23 |
| 2005/0011544 | A1 * | 1/2005 | Rosenbauer et al. | 134/57 D |
| 2005/0050647 | A1 * | 3/2005 | Tanaka et al. | 8/158 |
| 2005/0109070 | A1 * | 5/2005 | Kobayashi et al. | 68/3 R |
| 2008/0105001 | A1 * | 5/2008 | Jeong et al. | 68/12.02 |
| 2008/0141159 | A1 | 6/2008 | Iggulden et al. | |

(Continued)

FOREIGN PATENT DOCUMENTS

| | | | | |
|---|---|---|---|---|
| EP | 2040211 | A1 | 3/2009 | |
| KR | 10-2012-0100178 | * | 9/2012 | D06F 33/02 |

OTHER PUBLICATIONS

Appolicious® iPhone and iPad App Directory Laundry Pal (http://www.appolicious.com/shine/apps/37134-laundry-pal-hipfire/devel-oper_notes) accessed Apr. 15, 2011.

(Continued)

*Primary Examiner* — Boris Pesin
*Assistant Examiner* — Justin Lee

(57) ABSTRACT

A method of sorting articles for subsequent treatment in an appliance. The method may sort the articles on a mobile device and the sorted articles may be treated according to a cycle of operation implemented by the appliance.

21 Claims, 5 Drawing Sheets

(56) References Cited

U.S. PATENT DOCUMENTS

| | | | | |
|---|---|---|---|---|
| 2009/0075242 | A1 | 3/2009 | Schwarzberg et al. | |
| 2009/0075781 | A1 | 3/2009 | Schwarzberg et al. | |
| 2009/0076335 | A1 | 3/2009 | Schwarzberg et al. | |
| 2009/0076842 | A1 | 3/2009 | Schwarzberg et al. | |
| 2009/0076903 | A1 | 3/2009 | Schwarzberg et al. | |
| 2009/0077007 | A1 | 3/2009 | Schwarzberg et al. | |
| 2009/0134213 | A1 | 5/2009 | Ha | |
| 2010/0019035 | A1* | 1/2010 | Larson et al. | 235/385 |
| 2010/0083280 | A1 | 4/2010 | Schwarzberg et al. | |
| 2010/0139721 | A1* | 6/2010 | Beaudet et al. | 134/57 D |
| 2010/0283573 | A1* | 11/2010 | Yum et al. | 340/3.1 |
| 2013/0239337 | A1* | 9/2013 | Kim et al. | 8/137 |
| 2014/0018962 | A1* | 1/2014 | Jung et al. | 700/275 |
| 2014/0058553 | A1* | 2/2014 | Lee et al. | 700/143 |

OTHER PUBLICATIONS

App Review: CareAce Samsung Eco Bubble Wash Guide (http://www.careace.net/2011/03/29/app-reviewsamsung-eco-bubble-wash-guide/) accessed Apr. 15, 2011.

BlackBerry App World—Purex Laundry Help Purex Laundry Help (http://appworld.blackberry.com/webstore/content/11761) accessed Apr. 18, 2011.

Healthy Recipes—By SparkRecipes for iPhone, iPod touch, and iPad on the iTunes App Store Spark Recipes (http://itunes.apple.com/us/app/healthy-recipes-bysparkrecipes/id341637587?mt=8&ign-mpt=uo%3D4#) accessed Apr. 15, 2011.

Whole Foods Market Recipes App Review—Best iPhone Recipe Apps Whole Foods Market (http://ipod.about.com/od/summeriphoneapps/fr/whole-foodsrecipes-app-review.htm) accessed Apr. 15, 2011.

Allrecipes.com Dinner Spinner—Recipes, Drinks, and more! for iPhone, iPod touch, and ipad Dinner Spinner (Allrecipes.com) (http://itunes.apple.com/us/app/allrecipes-com-dinnerspinner/id299515267?mt=8&ign-mpt=uo%3D4) accessed Apr. 15, 2011.

Top recipe app for the iPhone, Dinner Spinner, comes to Android | Limitless DROID Allrecipes.com Dinner Spinner (http://limitlessdroid.com/2011/03/14/top-recipe-app-for-the-iphone-dinner-spinner-comes to Android) accessed Apr. 15, 2011.

* cited by examiner

METHOD OF SORTING ARTICLES FOR TREATMENT ACCORDING TO A CYCLE OF OPERATION IMPLEMENTED BY AN APPLIANCE

BACKGROUND OF THE INVENTION

Appliances, such as a washing machine or a dishwasher, may implement a cycle of operation on articles placed therein. Each appliance may have any number of cycles of operation that may be selected. At least some of the cycles of operation may be specific to one or more characteristics of an article, leading to the need to group the articles. In some instances, it may be difficult for a user to know which articles should be grouped together within the appliance and/or to know what cycle of operation to select to achieve a desired outcome on the articles.

SUMMARY

A method of sorting articles on a mobile device for subsequent treatment in an appliance includes receiving as input to the mobile device the articles to be treated, identifying at least one treating criteria for each of the inputted articles, grouping the inputted articles based on the treating criteria, determining a cycle of operation for the appliance based on the grouping, and displaying on the mobile device at least one of the groupings and the determined cycle of operation.

DESCRIPTION OF EMBODIMENTS OF THE INVENTION

Figure 1:
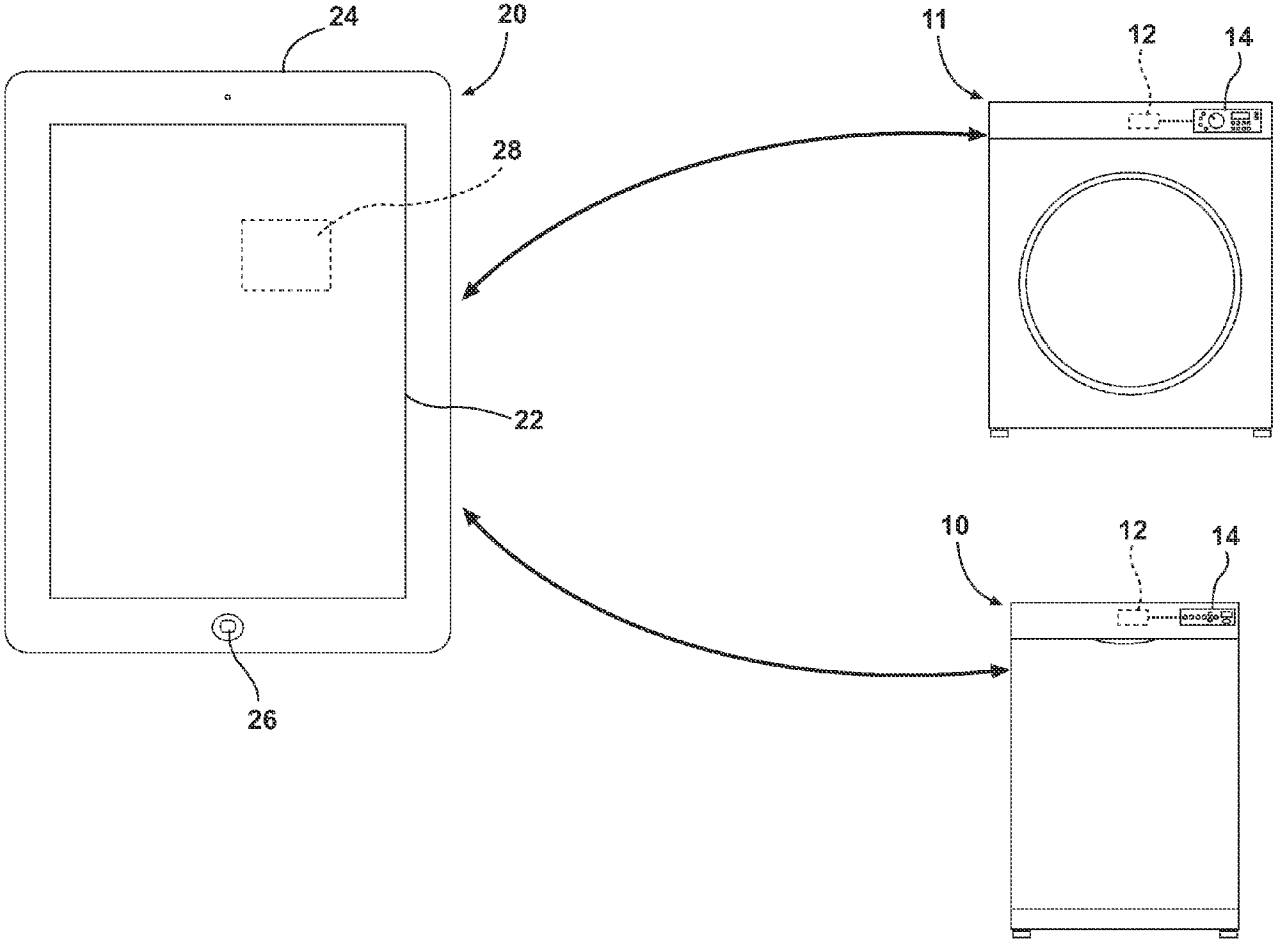
FIG. 1 is a schematic illustration showing two appliances having communication capabilities and which are communicably connected to a mobile device according to the invention.

FIG. 1 illustrates two exemplary appliances, designated generally by the numerals 10, 11, which may be configured to communicate with an exemplary mobile device 20. The two exemplary appliances have been illustrated in the form of a dishwasher 10 and a clothes washing machine 11; however, it is contemplated that the appliance may be any suitable appliance, non-limiting examples of which include a horizontal or vertical axis washing machine; a horizontal or vertical axis automatic dryer; a combination washing machine and dryer; a tumbling or stationary refreshing/revitalizing machine; an extractor; a non-aqueous washing apparatus; a revitalizing machine, a dishwasher, a refrigerator, a freezer, an oven, a microwave oven, and the like. While only household appliances have been illustrated it is contemplated that the appliance may be any suitable appliance including, by way of non-limiting example, an appliance used in a commercial setting.

Each appliance 10, 11 may be configured to perform a cycle of operation to complete a physical operation on an inanimate article. Examples of such physical operations may include, by way of non-limiting examples, a cleaning operation, a fabric treatment operation, a food preparation operation, and a food preservation operation.

Many of the appliances will include a treating chamber that receives the article while it is being processed. For example, a typical refrigerator will have at least one of a chilled compartment or a freezer compartment; a dishwasher has a tub in which dishes and the like are received; a clothes washer has a drum/basket in which the laundry is received; and a clothes dryer has a drum in which the laundry is received.

Each appliance 10, 11 may include components that may include anything that participates in the operation of the appliance 10, 11. Examples include a controller 12 (shown in phantom), a user interface 14, and one or more devices (not shown) such as pumps, valves, motors, heaters, I/O devices and the like, which may or may not be controlled by a controller. The controller 12 may include both memory and a central processing unit. The memory may be used for storing control software in the form of executable instructions that may be executed by the CPU in implementing one or more cycles of operation. The controller 12 may be capable of communication with other components of the appliance 10, 11 to control the operation of all of the components and the associated devices to implement an operation or cycle for the appliance 10, 11. The controller 12 may also be coupled with the user interface 14 for receiving user-selected inputs and communicating information to the user. The user interface 14 may enable a user to actuate and specify the parameters for various operations of the appliance 10, 11. The user interface 16 can include, but is not limited to, any number of well-known features, such as a digital display, speakers, a touch screen, a key pad, buttons, switches, dials, lights, and the like.

The controller 12 may also be capable of communicating through wireless signals with the mobile device 20 such that the capability, functionality, and usability of the appliance 10, 11 may be expanded. Although illustrated as a portion of the controller 12, such communication capabilities may alternatively include a separate communication link, which may include any suitable connecting device, such as a wire or wireless port, an Ethernet connector, a wireless-G connector, a USB port, a serial port, and the like, which may be capable of connecting the appliance 10, 11 to the mobile device 20.

The mobile device 20 may include a display screen 22, a housing 24, a power/control button 26, and a controller 28 (shown in phantom). Although the mobile device 20 is depicted as a tablet or pad computing device, it can be any number of known mobile electronic devices with a display screen 22 including, but not limited to a smart phone, a laptop computer, a netbook, a digital media reader, or a personal digital assistant. The mobile device 20 may further have a variety of user input mechanisms (not shown) including but not limited to a keyboard, mouse, pullout keyboard, electronic pop-up keyboard, touch sensitive display screen, motion sensors, such as micro-electromechanical system (MEMS) based multi-axis accelerometers, voice recognition, and handwriting recognition. Further, the mobile device 20 may include a camera and software for processing an image captured with the camera, which may act as an additional user input mechanism.

The present discussion will focus on a mobile device 20 with a touch sensitive input display screen 22 for receiving input from a user and displaying output to the user. The controller 28 may receive input from the user through the touch display screen 22 and display visual output to the user in the form of graphics, texts, icons, video and any combination thereof. The touch display screen 22 may receive input from the user based on tactile contact, such as by a user touching the touch display screen 22 with an object, such as a finger. The controller 28 may detect contact, including movement of the contact, on the screen 22 and convert the detected contact into interaction with the objects (graphics, texts, icons, etc.) displayed on the touch display screen 22. The controller 28 may be programmed to detect contact and movement of a contact according to any known methodology. The touch display screen 22 may be any suitable type of touch display screen, such as a liquid crystal display (LCD) or light emitting polymer display (LPD). Non-limiting examples of suitable touch sensing technologies that may be used with the touch display screen 22 include capacitive, resistive, infrared, pressure and surface acoustic waves.

The controller 28 may have a microprocessor and memory (not shown) to store and execute system and application software to operate the mobile device 20 including software capable of sorting articles for subsequent treatment in the appliance 10, 11, identifying treating criteria for said articles, grouping said articles, and determining a cycle of operation for said articles. The controller software may be executed by the controller 28 to sequentially display on the touch display screen 22 and navigate through a variety of input/output screens based on the user input received from the touch display 22. Each input/output screen may provide the user with the opportunity to input and may provide output to communicate information with the user. It is contemplated that the mobile device 20 may run and operate on any known operating system. The controller 28 of the mobile device 20 may be capable of communicating through wireless signals with the appliance 10, 11 to provide a cycle of operation to the appliance 10, 11. It should be noted that the appliances 10, 11 may communicate with the mobile device 20 to provide the user with status messages or provide the controller 28 with a list of available cycles of operation to select from.

Such a wireless link may be any known type of communication link including, but not limited to, a Wireless Fidelity (WiFi®) signal, a WiMax™ signal, a Bluetooth® signal, a ZigBee™ signal, 3G wireless signal, a code division multiple access (CDMA) wireless signal, a global system for mobile communication (GSM) signal, a 4G wireless signal, a long term evolution (LTE) signal, an Ethernet signal, and/or any combinations thereof. It will also be understood that the particular type or mode of wireless communication is not critical to this invention, and later-developed wireless networks are certainly contemplated as within the scope of this invention. Further, the mobile device 20 may be communicably coupled with the appliance 10, 11 through a wired link without changing the scope of this invention. The mobile device 20 may also be enabled to connect to other devices and networks.

According to the invention, the mobile device 20 may receive input regarding the articles to be treated and may output a cycle of operation to the appliance 10, 11 for the appliance 10, 11 to execute. In this manner the mobile device 20 may be used to control the appliance 10, 11. This unique ability enables the mobile device 20 to instruct the operational capabilities and behavior of the appliance 10, 11 temporarily without requiring any input from the user directly to the appliance 10, 11 or its components.

Figure 2:
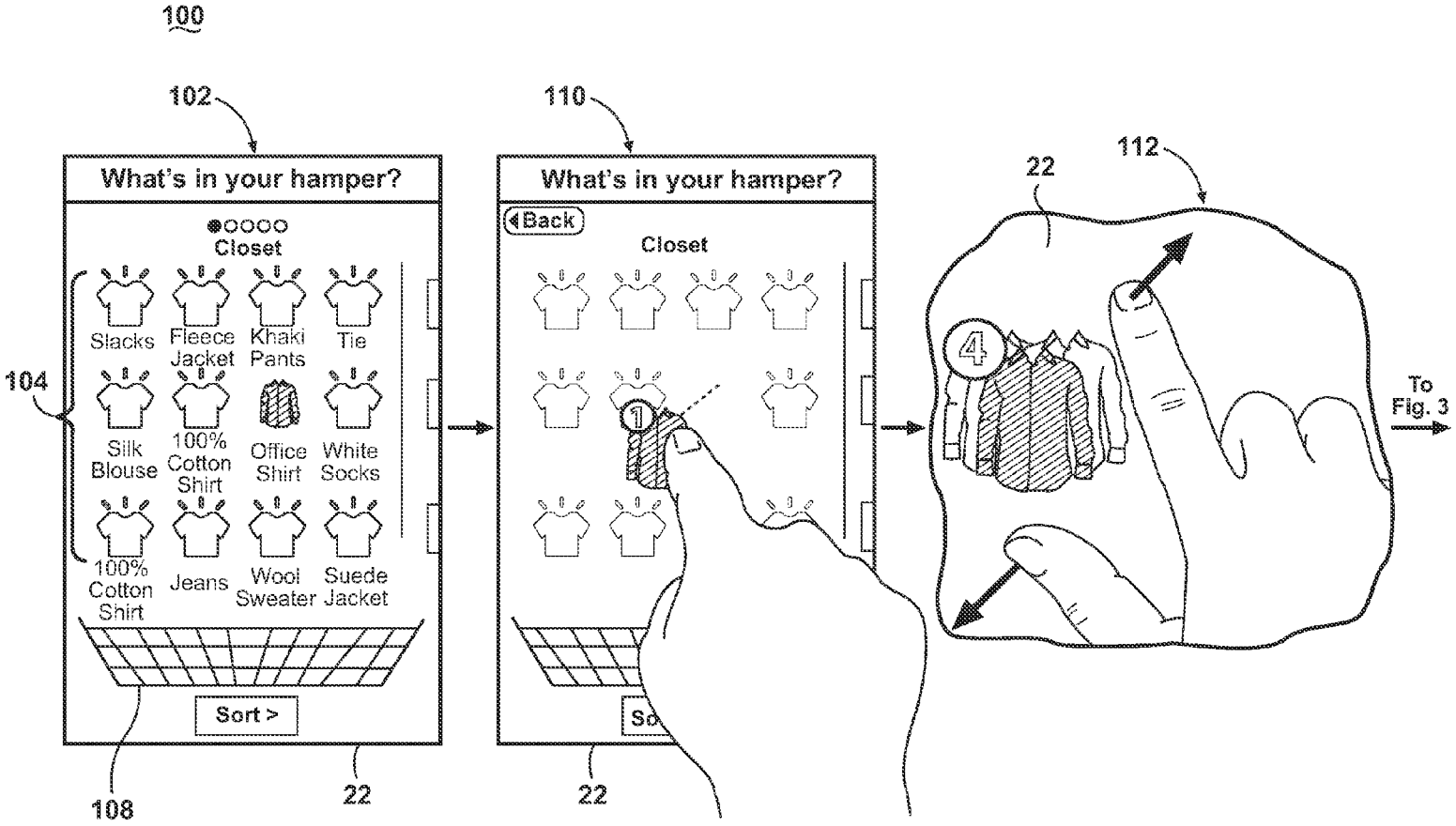
FIGS. 2-4 are a series of front views of a screen of the exemplary mobile device of FIG. 1 illustrating a method of sorting articles on a mobile device for subsequent treatment in an appliance according to a first embodiment of the invention.
Figure 3:
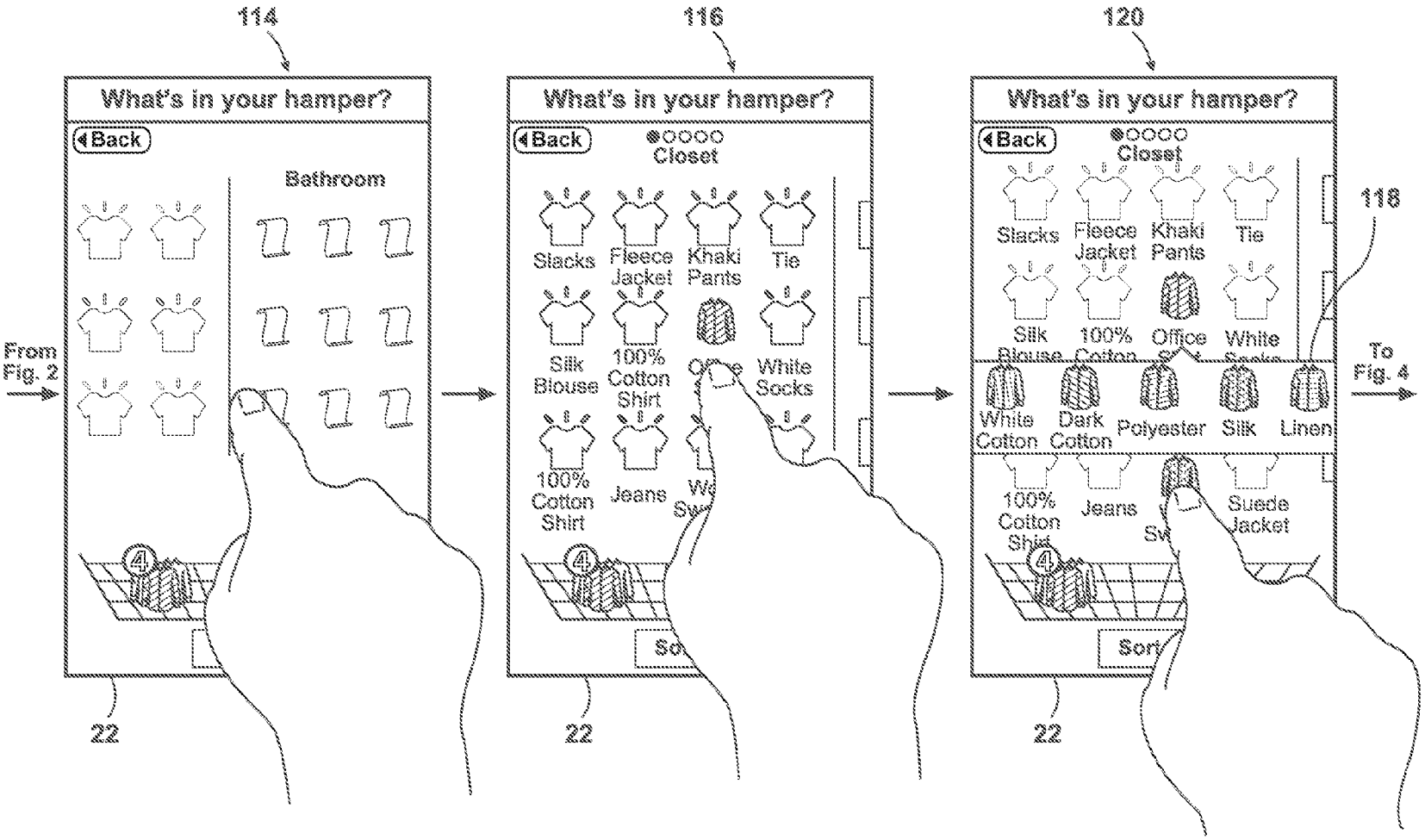
Figure 4:
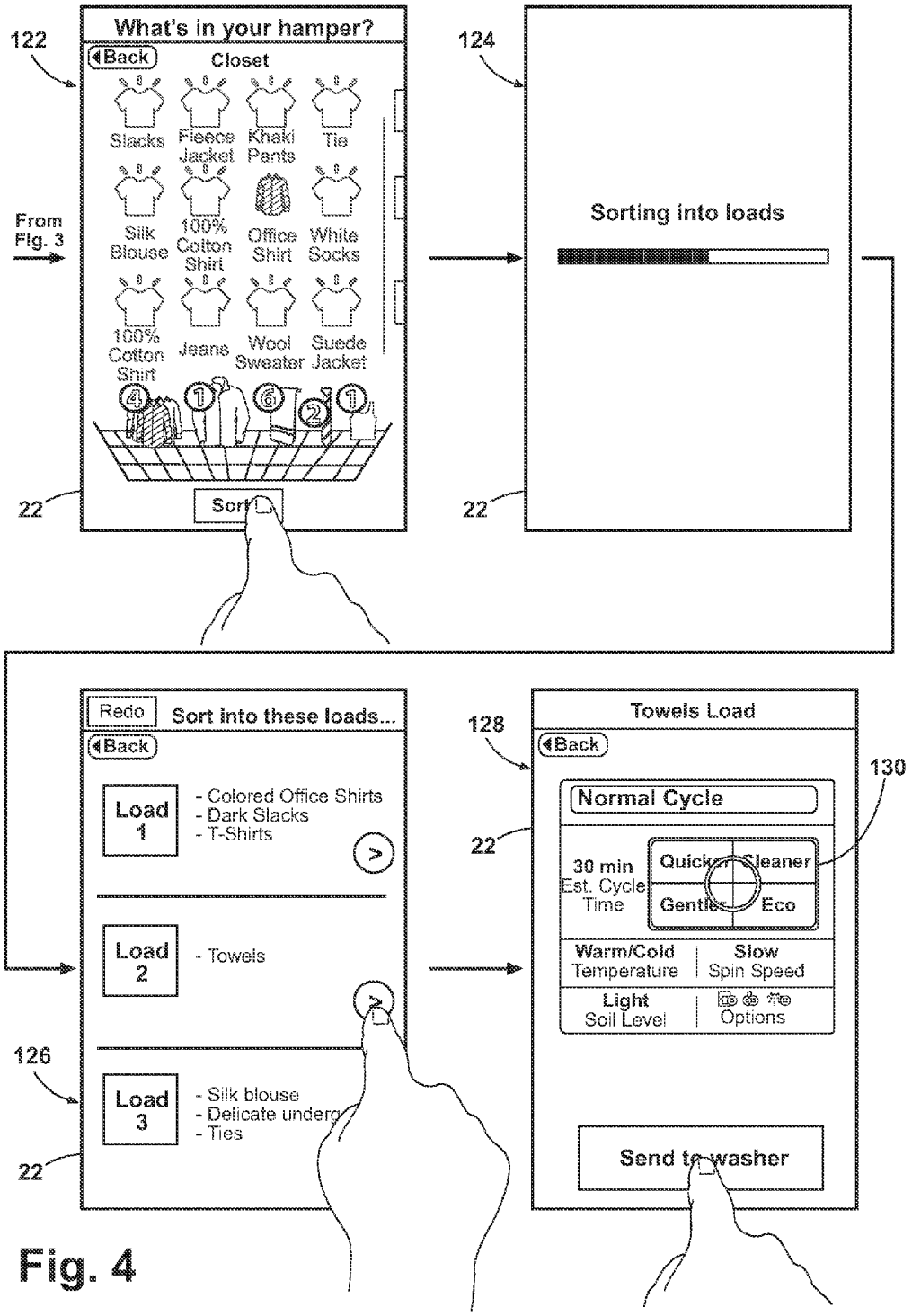

For example, FIGS. 2-4 graphically illustrate a method 100 for sorting articles, which are illustrated as laundry articles 104, on the mobile device 20 for subsequent treatment in a appliance such as the clothes washing machine 11. The method 100 is represented by a series of input/output screen displays, which may be generated by a computer program being executed on the controller 28 and displayed on the display screen 22. The method 100 may be carried out by the controller 28 using information inputted by the user via the display screen 22. It will be understood that the method 100 pertains to laundry articles and a laundry treating appliance such as a clothes washing machine 11. The sequence of steps depicted is for illustrative purposes only and is not meant to limit the method 100 in any way as it is understood that the steps may proceed in a different logical order, additional or intervening steps may be included, or described steps may be divided into multiple steps, without detracting from the invention.

Referring to FIG. 2, at the beginning of the method 100 an input/output screen may be presented to the user via the display screen 22 and such display may include a list of user-selectable articles 104 as shown in the illustrative example at 102. The input/output display on the screen 22 may prompt the user to select which items are to be treated, such as those laundry articles in the user's hamper. A range of laundry articles may be listed in the list of user-selectable articles 104 and the list of user-selectable articles 104 may be written and/or pictorial. By way of non-limiting example, each article listed may include both a written description and an icon, which may be generally understood as depicting a laundry article. Such icons may be the same for varying articles as in the illustrated example or the icons may vary with the each of the articles listed in the list of user-selectable articles.

The user may select articles from the list of user-selectable articles 104 and put them in the hamper 108 located at the bottom of the input/output display to indicate that the selected articles are in the user's hamper as illustrated at 110. By way of non-limiting examples, the user may select the article from the list of user-selectable articles 104 in a variety of manners including by dragging it into the hamper 108, flicking it towards the hamper 108, or double tapping on the article to have it automatically placed in the hamper 108. When the user selects the article from the list of user-selectable articles 104 the addition of the article into the hamper 108 may default to the addition of a single article of the selected type of article. If the user would like to add multiple articles of that article type to the hamper 108, then the user may use a spread gesture as shown at 112 to increase the number of articles located in the hamper 108. Conversely, a shrink gesture may be used to decrease the number of articles located in the hamper 108.

Referring now to FIG. 3, depending on the length of the list of user-selectable articles 104, the list of user-selectable articles 104 may be shown on several input/output screens, which a user may access and toggle between as shown at 114. Further, the list of user-selectable articles 104 may be categorized by location within the home and such locations may be selected from various options. For example, the input/output screen display may include location options including closet, bureau, kitchen, bathroom, bedroom, and locker. It will be understood that the articles illustrated in the list of user-selectable articles 104 for each location may vary. By way of non-limiting example towels, bathmats, and wash cloths may be included in the articles illustrated in the list of user-selectable articles 104 for the bathroom.

The controller 28 may receive as input the selection of the articles from the list of user-selectable articles 104. Further, if a user taps an article such as shown at 116, a list of user-selectable characteristics and properties 118 for the selected article may be displayed as illustrated at 120. The user may scroll through the list of user-selectable characteristics and properties 118 and select appropriate characteristics and properties from the list. By way of non-limiting example, a characteristic of an article may include an aspect related to the article, such as that the article should be washed in cold water, not warm. While the characteristic relates to the article the treatment of the article may not be limited to such characteristic. By way of non-limiting example, properties of an article may include inherent aspects of the article such as the article color, and/or an article type. Examples of article types are cotton, silk, polyester, delicates, permanent press, and heavy duty. In this manner the controller 28 may receive as input both the selection of the article and a selection of at least one of a characteristic and a property for that article. Similarly, a list of user-selectable stains (not shown) may also be displayed separately or in conjunction with the list of user-selectable characteristics and properties 118 and the controller 28 may receive as input a selection of at least one stain displayed on the list. The user may continue to select articles and the controller 28 may continue to receive as input the articles to be treated until the user determines that no more articles need to be added to the hamper 108.

As input regarding the articles to be treated is received by the controller 28, the controller 28 may identify at least one treating criteria for each of the inputted articles based on the received input of the articles to be treated. The treating criteria may include any standard by which the laundry articles may be subsequently sorted and grouped. Such treating criteria may include, but is not limited to, the available cycles the clothes washing machine 11 may run as well as at least one of a characteristic and a property for each article. Identifying such treating criteria for each article may include executing a set of instructions in the controller 28 that may indicate treating criteria for each selected article. More specifically, based upon the received input regarding the articles, the set of instructions may tell the controller 28 how each article should be treated. Such treating criteria may include at least one characteristic or property for the selected articles and may include by way of non-limiting examples that the article is delicate and should be washed in cold water.

Alternatively, the identification of the treating criteria for each of the inputted articles may occur after a user selects that the laundry should be sorted as illustrated at 122 in FIG. 4. Regardless of the sequence, once at least one treating criteria for each selected article is identified for each of the inputted articles the articles may be grouped based on the treating criteria. A display screen may indicate that that mobile device 20 is sorting the articles into loads at 124 and at 126 an input/output display may indicate the loads the articles have been grouped into and how the user should subsequently sort the articles. The grouping of the inputted articles may be based on a variety of factors including the treating criteria. In this manner, such groupings may relate to water temperatures and desirable treating conditions for the inputted articles. Such groupings may also be based on a variety of other factors such as load sizes based upon user preference or the capacity of the clothes washing machine 11.

At 126 the user may select which load the user is interested in treating or which load has been loaded into the appliance. Based on the selected grouping a cycle of operation for the appliance may be determined. The cycle of operation may be determined based on the characteristics or properties of the articles in the group. By way of non-limiting example, the determined cycle of operation may correspond to a type of fabric, a soil level, a color or an amount or size of one or more laundry items in the grouped articles. Available cycles of operation for the appliance may also be taken into consideration and such available cycles of operation may be received as input to the controller 28 either as an assumed standard set of cycles of operation, transmission from the appliance 10, or through user input. It is also contemplated that the cycles of operation may be determined before the user selects which load is to be treated and that such cycles of operation may also be displayed when the groupings are displayed at 126.

The determined cycle of operation may include various cycle parameters or operating parameters that may be set automatically by the controller 28 when the user selects one of the groupings. For example, the controller 28 may automatically adjust the liquid temperature used during the cycle of operation based on the selected grouping. Non-limiting examples of such operating parameters, may include temperature, drum speed, amount of water used, a type of treatment to dispense, an amount and/or concentration of a treatment to dispense, a time to dispense a treatment, a duration of a soak or pre-soak phase, a temperature of a soak or pre-soak, a tumble speed and duration, a spin speed and duration, an imbalance limit, a cycle or cycle phase delay, whether to perform a soak or pre-soak phase, and a number of times a phase in the cycle is repeated (e.g. the number of rinses).

At 128 the screen 22 may display in the form of text and/or graphics one or more of the selected grouping, the determined cycle of operation, cycle information, and cycle parameter. Non-limiting examples of cycle information that may be communicated to the user includes the estimated cycle time, soil level setting or the status of a cycle modifier (e.g. pre-soak or extra rinse), and selected operating parameters such as wash and rinse temperature and the spin speed.

It is contemplated that a user may have preferences and/or specific goals or outcomes with respect to each load and that the mobile device 20 may be configured such that one or more of the operating parameters may be set by the user to modify the determined cycle of operation according to the user's preferences. Thus, it is contemplated that the user may have the ability to make changes to the operating parameters via this display screen at 128. For example, the user may manually adjust the wash temperature to a desired wash temperature different than the default temperature for the determined cycle. Further, additional input/output screens may be displayed in which the user may adjust one or more operating parameters and each subsequent input/output screen displayed to the user on the touch display screen 22 may be based on user input from the previously displayed input/output screen. By way of non-limiting examples, such user preferences may include at least one of: cost, ecology, and cycle duration.

It may be understood that some user preferences may be input without respect to a specific operating parameter and that the controller 28 may receive as input such user preferences and may then select a cycle of operation or alter default operating parameters for the determined cycle of operation based on the received input. One way in which a user may input a user preference without changing a specific operating parameter on the display screen is through a performance goal selection display 130, which may be included at 128. In this manner, the user may select a performance goal through the touch display screen 22 and the controller 28 may adjust the operating parameters of the determined cycle of operation to achieve the selected performance goal. Such a performance goal selection display and is set forth in detail in U.S. patent application Ser. No. 12/640,514, filed Dec. 17, 2009, and titled "Laundry Treating Appliance Control System," which is incorporated herein by reference in its entirety and may allow a user to select four user-selectable performance goals "Quicker", "Cleaner", "Gentler" and "Eco" (environmentally friendly), respectively. Thus, the controller 28 may receive as input such user preferences and may then select the cycle of operation or parameters for the determined cycle of operation based on the received input.

The user may then select to output the cycle of operation from the mobile device 20 to the appliance as illustrated at 128. In this manner the mobile device 20 may group the articles, the user may select a grouping and output to the clothes washing machine 11 the cycle of operation for the selected group. The controller 12 may control the components of the clothes washing machine 11 to complete the cycle of operation output by the mobile device 20.

Figure 5:
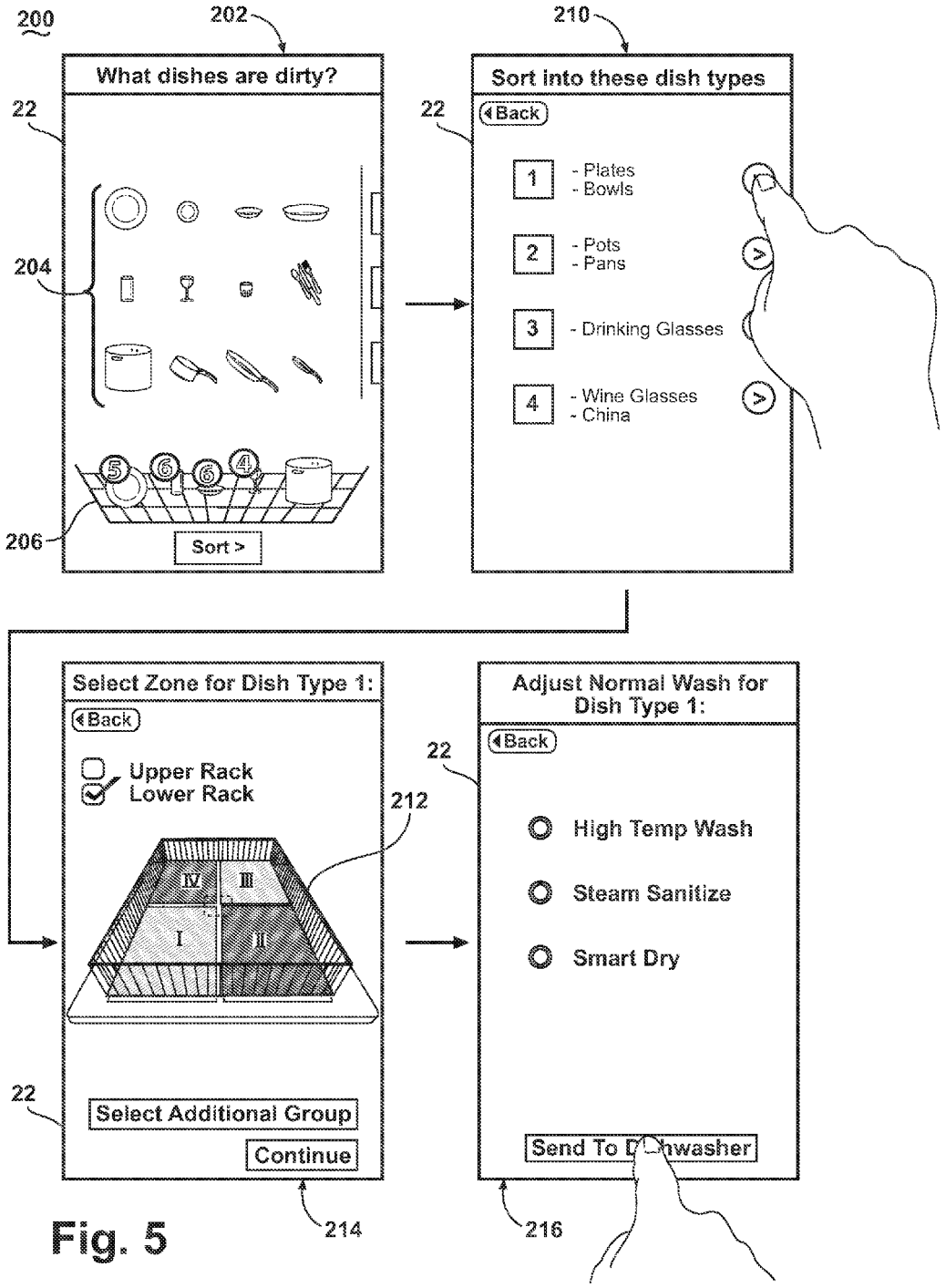
FIG. 5 is a series of front views of a screen of the exemplary mobile device of FIG. 1 illustrating a method of sorting articles on a mobile device for subsequent treatment in an appliance according to a second embodiment of the invention.

FIG. 5 graphically illustrates a method 200 for sorting articles on the mobile device 20 for subsequent treatment in an appliance such as the dishwasher 10 according to a second embodiment of the invention. The method 200 is represented by a series of input/output screen displays, which may be displayed on the display screen 22. The method 200 may be carried out by the controller 28 using information inputted by the user via the display screen 22. It will be understood that the method 200 pertains to dishes and a dishwasher. For purposes of this description, the term "dish(es)" is intended to be generic to any item, single or plural, that may be treated in a dishwasher, including, without limitation; dishes, plates, pots, bowls, pans, glassware, and silverware. The sequence of steps depicted is for illustrative purposes only and is not meant to limit the method 200 in any way as it is understood that the steps may proceed in a different logical order, additional or intervening steps may be included, or described steps may be divided into multiple steps, without detracting from the invention.

At the beginning of the method 200 an input/output screen may be presented to the user via the display screen 22 and the controller 28 may receive as input to the mobile device 20 regarding the articles to be treated. As with the above described method 100, at 202 the input/output display on the screen 22 may ask the user which items are to be washed or which items are dirty and provide the user with a list of user-selectable articles 204 such that the user may place the appropriate dishes in the basket 206 and the controller 28 may receive as input the selection of the articles from the list of user-selectable articles 204. As with the first embodiment various user-selectable stains, characteristics, and properties for the selected article may also be displayed and received as input by the controller 28.

Once the user selects the appropriate articles and the controller 28 receive as input the articles to be treated the user may select that the dishes be sorted. In sorting the dishes at least one treating criteria for each of the inputted articles may be identified and the inputted articles may be grouped based on the identified treating criteria and such groups may be displayed at 210. The user may then continue by selecting one of the groupings.

At this point it is contemplated that a list or display of user-selectable wash zones 212 may be shown as illustrated at 214 and that the user may select at least one of the multiple wash zones from the display to indicate where the grouping will be placed within the dishwasher. Such a zonal selection and its use in a cycle of operation is set forth in detail in U.S. patent application Ser. No. 12/851,628, filed Aug. 6, 2010, and titled "Method for Controlling Zonal Washing in a Dishwasher," which is incorporated herein by reference in its entirety.

In this manner, the controller 28 may receive as input the grouping selection and selection of at least one of the multiple wash zones. Alternatively, it is contemplated that the user may first input the selected zone and then select a dish or grouping of dishes to indicate what zone it will be placed within. Further, it is contemplated that the wash zone selection step may be skipped altogether.

Regardless of the order or inclusion of the wash zone selection step a cycle of operation for the appliance based on the selected grouping may be determined and displayed on the mobile device at 216. The cycle of operation may be determined based on the characteristics or properties of the articles in the group and may be modified by the user as described above. Various options or parameters may be selected by the user at 216 and the cycle of operation may be modified or selected based thereon. The user may then select to output the cycle of operation from the mobile device 20 to the dishwasher 10. Thus, the mobile device 20 may group the dishes, the user may select a grouping and where that grouping will be placed within the dishwasher, and a cycle of operation may be selected and output to the dishwasher 10. The controller 12 may control the components of the dishwasher 10 to complete the cycle of operation output by the mobile device 20.

The methods described herein sort the articles to be treated into appropriate loads and then determine a cycle of operation for such loads. Such cycles may be output to the appliances for subsequent treatment of the articles. The above methods do not require any prior knowledge by the user regarding how to sort the articles or treat the articles. Users may be unaware of best sorting and treating protocols and such above described methods take out the guesswork, which results in articles which are properly sorted and treated, less damage to the articles, and increased user satisfaction. Such methods may also make the process more intuitive and informative for the user, further increasing user satisfaction and appliance efficiency.

While the invention has been specifically described in connection with certain specific embodiments thereof, it is to be understood that this is by way of illustration and not of limitation, and the scope of the appended claims should be construed as broadly as the prior art will permit. For example, the user may select items to be treated or input into the mobile device 20 the items to be treated in a variety of different manners. By way of an additional non-limiting example, a user may take a photograph of an item or a portion of an item, for example an article's cleaning tag, or a machine readable code such as a UPC to provide input to the mobile device 20 that the pictured item is to be treated. It is contemplated that the mobile device 20 may determine treating criteria for the article based on the picture or that such machine readable code may include treating criteria.

What is claimed is:

1. A method of sorting by a mobile device a plurality of selected laundry articles currently needing treatment in a laundry treating appliance, the method comprising:

displaying on the mobile device a list of a plurality of user-selectable laundry articles;

receiving at the mobile device inputs representative of the plurality of selected laundry articles, at least two of the selected articles appearing on the list and having different types;

identifying at least one treating criterion for each of the types;

identifying two or more groups of the selected laundry articles based on the treating criteria, the groups intended for treatment in separate cycles of operation;

automatically determining by the mobile device a cycle of operation for the appliance for each of the two or more groups; and displaying on the mobile device a representation of which selected laundry articles were identified as part of each of the two or more groups, and the determined cycle of operation for each group.

2. The method of claim 1, wherein identifying the at least one treating criterion comprises executing a set of instructions in a microprocessor in the mobile device.

3. The method of claim 1, wherein the at least one treating criterion comprises at least one of a characteristic and/or a property of the type.

4. The method of claim 3, wherein determining the cycle of operation is based on the at least one of the characteristic and/or the property.

5. The method of claim 1, wherein the list is organized by locations within a residence.

6. The method of claim 1, wherein the list comprises a pictorial list.

7. The method of claim 1, further comprising displaying a list of user-selectable stains, wherein receiving the inputs includes receiving a selection of at least one stain displayed on the list.

8. The method of claim 1, further comprising displaying a list of user-selectable characteristics and properties for the selected laundry articles, wherein receiving the inputs includes receiving a selection of at least one of a characteristic and/or a property displayed on the list.

9. The method of claim 1, wherein determining the cycle of operation comprises receiving input at the mobile device representative of available cycles of operation for the appliance, and selecting the cycle of operation from the available cycles of operation.

10. The method of claim 9, wherein receiving the input of the available cycles of operation comprises at least one of a transmission from the appliance and/or a user input.

11. The method of claim 9, further comprising receiving as input at the mobile device a user preference, wherein selecting the cycle of operation is based on the user preference.

12. The method of claim 11, wherein the user preference comprises at least one of a cost, an ecology, and/or a cycle duration.

13. The method of claim 1, wherein the displaying comprises displaying at least one parameter of at least one of the cycles of operation.

14. The method of claim 13, further comprising receiving as input a modification of the parameter from a user.

15. The method of claim 1, further comprising outputting a cycle of operation from the mobile device to the appliance.

16. The method of claim 15, further comprising receiving as input at the mobile device a selection of a group from the groupings, wherein outputting the cycle of operation comprises outputting the cycle of operation for the selected group.

17. The method of claim 1, wherein receiving the inputs representing the selected laundry articles to be treated comprises capturing images of the selected laundry articles to be treated and processing the captured images to determine the selected laundry articles to be treated.

18. A mobile device comprising:

a touch sensitive screen;

a processor; and a memory storing machine-readable instructions that when executed by the processor cause the mobile device to sort a plurality of selected laundry articles currently needing treatment in a laundry treating appliance by at least:

displaying on the touch-sensitive screen a list of a plurality of user-selectable laundry articles;

receiving on the touch-sensitive screen inputs representative of the plurality of selected laundry articles, at least two of the selected articles appearing on the list and having different types;

identifying at least one treating criterion for each of the types;

identifying two or more groups of the selected laundry articles based on the treating criteria, the groups intended for treatment in separate cycles of operation;

determining a cycle of operation for the appliance for each of the two or more groups; and displaying on the touch-sensitive screen a representation of which selected laundry articles were identified as part of each of the two or more groups, and the determined cycle of operation for each group.

19. The mobile device of claim 18, further comprising a wireless interface to output a cycle of operation from the mobile device to the appliance.

20. The mobile device of claim 18, further comprising a wireless interface to receive input representing available cycles of operation for the appliance, wherein determining a cycle of operation comprises selecting the cycle of operation from the available cycles of operation.

21. The mobile device of claim 20, wherein receiving the input representative of the available cycles of operation comprises receiving the input from the appliance via the wireless interface.

* * * * *